US010159300B2

(12) United States Patent
Muhammad

(10) Patent No.: US 10,159,300 B2
(45) Date of Patent: Dec. 25, 2018

(54) CONVERTIBLE FOOTWEAR APPARATUS

(71) Applicant: Yusuf A. Muhammad, Atlanta, GA (US)

(72) Inventor: Yusuf A. Muhammad, Atlanta, GA (US)

( * ) Notice: Subject to any disclaimer, the term of this patent is extended or adjusted under 35 U.S.C. 154(b) by 267 days.

(21) Appl. No.: 14/972,175

(22) Filed: Dec. 17, 2015

(65) Prior Publication Data

US 2017/0172245 A1 Jun. 22, 2017

(51) Int. Cl.
*A43B 3/24* (2006.01)

(52) U.S. Cl.
CPC ..... *A43B 3/242* (2013.01); *A43B 3/24* (2013.01)

(58) Field of Classification Search
CPC ..... A43B 3/24; A43B 3/242; A43B 3/244
USPC ..... 36/100, 101, 1.5
See application file for complete search history.

(56) References Cited

U.S. PATENT DOCUMENTS 2,230,291 A * 2/1941 Evans ..... A43B 3/02 36/1.5
2,235,490 A * 3/1941 Saksa ..... A43B 3/16 36/1
2,261,125 A * 11/1941 McFeely ..... A43B 3/24 36/101
2,302,596 A * 11/1942 Bigio ..... A43B 3/24 36/101
3,087,260 A 4/1963 Hudon
3,477,147 A 11/1969 Bauer
4,064,641 A * 12/1977 Levine ..... A43B 3/00 2/232
4,244,121 A * 1/1981 Adams ..... A43B 23/06 12/142 F
4,333,248 A * 6/1982 Samuels ..... A43B 3/18 36/101
4,896,437 A * 1/1990 Johnson ..... A41D 17/00 2/22
5,109,614 A * 5/1992 Curry ..... A43B 7/20 36/100
5,642,573 A * 7/1997 Brown ..... A41D 17/00 36/132
6,477,788 B1 * 11/2002 Chen ..... A43B 3/166 36/1.5
7,013,587 B2 * 3/2006 Yama ..... A43B 3/24 36/101
7,219,443 B2 * 5/2007 Czaplewski ..... A41D 17/00 36/2 R
7,614,165 B2 * 11/2009 Curry ..... A43B 1/0081 36/101
8,046,935 B2 * 11/2011 Parisi ..... A43B 3/166 36/2 R
8,065,321 B2 11/2011 Reid
8,065,821 B1 * 11/2011 Reid ..... A43B 3/242 36/1.5

(Continued)

*Primary Examiner* — Marie Bays
(74) *Attorney, Agent, or Firm* — Alston & Bird LLP

(57) ABSTRACT

According to the present invention, a convertible footwear apparatus can be worn as a shoe or converted to a boot by attaching or removing an upper section from the shoe. The apparatus is configured to allow someone wearing the shoe component to attach or remove the upper section with a single continuous operation and without having to remove the shoe component from the wearer's foot. In one embodiment of the invention, the apparatus comprises a zipper. In another embodiment of the invention, the shoe component includes a heel.

4 Claims, 5 Drawing Sheets

(56) References Cited

U.S. PATENT DOCUMENTS

| | | | | |
|---|---|---|---|---|
| 8,863,406 | B2 * | 10/2014 | Moore | A43B 3/242 36/1.5 |
| 2004/0231197 | A1 * | 11/2004 | Yama | A43B 3/24 36/101 |
| 2006/0032084 | A1 * | 2/2006 | Pang | A43B 1/0027 36/7.1 R |
| 2007/0199212 | A1 * | 8/2007 | Threlkeld | A43B 3/24 36/101 |
| 2008/0086914 | A1 * | 4/2008 | Curry | A43B 1/0081 36/101 |
| 2010/0186259 | A1 | 7/2010 | Garza | |
| 2014/0165425 | A1 * | 6/2014 | Byam | A43B 1/0081 36/100 |

* cited by examiner

CONVERTIBLE FOOTWEAR APPARATUS

BACKGROUND OF THE INVENTION

This invention relates generally to the field of footwear and more specifically to new and useful convertible footwear. There are many different types of footwear, which are designed for different types of utility and aesthetics. Two common types of footwear are shoes and boots, the primary distinguishing factor being that boots cover parts of the leg that shoes do not. For numerous reasons, including weather, fashion, and utility, a person may desire a boot rather than a shoe, or vice versa. Typically, footwear is either a shoe or a boot, but not a single apparatus designed to convert from one into the other. Therefore, when a person wishes to change from a shoe to a boot, or vice versa, that person must have both a shoe and a boot. It is inconvenient and costly for a person to acquire and store both types of footwear, which may often be in the same style. And it is even more cumbersome for a person to carry both types of footwear on his or her person should it be desirable to change footwear without, for instance, returning home.

Prior art systems have addressed this issue by using upper sections that can be attached to or removed from a shoe to create a boot when desired. An example of such a system is disclosed in U.S. Pat. No. 8,863,406. Another example of such a system is disclosed in U.S. Patent Application Publication 2010/0186259. The problem with these systems is that the upper section cannot be attached or removed while a person is currently wearing the shoe. This is because the upper section is configured like a tube that the wearer must slide their leg into. Thus, a person wearing the shoe must remove the shoe when converting from a shoe to a boot or vice versa.

In order to allow a person wearing a shoe to convert to a boot, and vice versa, without having to remove the shoe, prior art systems have configured upper sections that split or separate such that they wrap around the wearer's leg. However, these systems require multiple couplings—one coupling between the upper section and the shoe, and another coupling to hold the upper section together when wrapped around the leg. One example of such a system uses two zippers, as shown in U.S. Pat. No. 3,087,260. Another example of such a system uses a plurality of buttons and laces, as shown in U.S. Pat. No. 9,065,831. These types of systems are overly cumbersome to the wearer, require more components, and are more difficult to conceal.

Thus, there is a need for a convertible footwear apparatus that can convert from a shoe to a boot, and vice versa, without a person wearing the shoe having to remove the shoe and without needing multiple coupling mechanisms that needlessly overburden both the manufacturer and the wearer.

BRIEF SUMMARY OF THE INVENTION

The present invention solves the problem of a convertible footwear apparatus that can convert from a shoe to a boot, and vice versa, without a person wearing the shoe having to remove the shoe and without needing multiple coupling mechanisms that needlessly overburden both the manufacturer and the wearer. In a preferred embodiment of the invention, the convertible footwear apparatus includes an upper section, a shoe, and a coupling mechanism. The upper section may be configured to be split or separated such that it can be wrapped and unwrapped around a person's leg. In accordance with the invention, one side of the upper section may be removably attached to another side of the upper section and the upper section may be removably attached to the shoe, with a single continuous operation. In another preferred embodiment, the coupling mechanism comprises a zipper. In another preferred embodiment, the shoe further comprises a heel.

BRIEF DESCRIPTION OF THE FIGURE(S)

Having thus described the invention in general terms, reference will now be made to the accompanying figures, which are not necessarily drawn to scale, and wherein:

DETAILED DESCRIPTION OF THE INVENTION

The present invention now will be described more fully hereinafter with reference to the accompanying figures, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
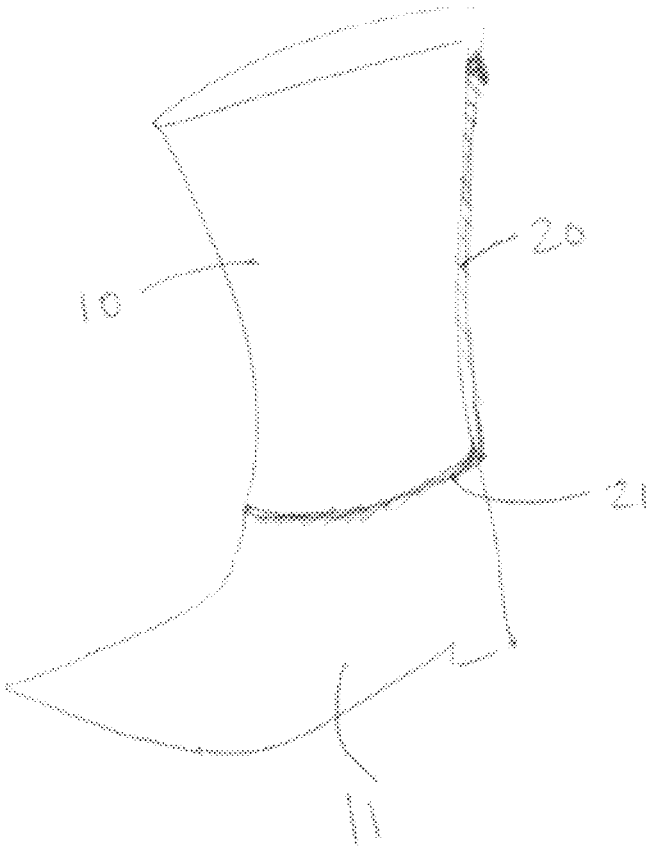
FIG. 1 shows an exemplary embodiment of the invention illustrating footwear that is convertible from a shoe to a boot.

As illustrated in FIG. 1, a preferred embodiment of the invention may include an upper section 10 and a shoe 11. Upper section 10 may be comprised of leather, plastic, suede, or any other material known to a person of ordinary skill in the art. Shoe 11 may be comprised of the same material as upper section 10 or a different leather, plastic, suede, or any other material known to a person of ordinary skill in the art. Upper section 10 may be removably coupled to shoe 11 by a coupling mechanism 21, such that upper section 10 can be attached and then detached from shoe 11. Coupling mechanism 21 may be comprised of a zipper, magnets, Velcro, buttons, or any other coupling mechanism known to a person of ordinary skill in the art. Additionally, one side of the coupling mechanism may be fixed to upper section 10 while the other side of the coupling mechanism may be fixed to the shoe 11. For example, in one preferred embodiment, the coupling mechanism 21 comprises a zipper. In a preferred embodiment, one half of the zipper may be fixed to upper section 10 by using epoxy, stitching, or any other numerous methods known to a person of ordinary skill in the art. The other half of the zipper may be fixed to shoe 11 by using epoxy, stitching, or any other numerous methods known to a person of ordinary skill in the art.

The upper section 10 may be split or separated such that it can be wrapped around or removed from a person's leg without the person's leg needing to thread through the upper section like a tube. Therefore, a person wearing shoe 11 may convert from a shoe to a boot, and vice versa, without having to remove the shoe 11 from the person's foot or having to thread the shoe 11 through the upper section 10. The upper section 10 may be removably fixed around a person's leg using a coupling mechanism 20. Coupling mechanism 20 may be comprised of a zipper, magnets, Velcro, buttons, or any other coupling mechanism known to a person of ordinary skill in the art. Additionally, one side of the coupling mechanism may be fixed to one side of upper section 10 while the other side of the coupling mechanism may be fixed to the other side of upper section 10. For example, in one preferred embodiment, the coupling mechanism 20 comprises a zipper. In a preferred embodiment, one half of the zipper may be fixed to one side of upper section 10 by using epoxy, stitching, or any other numerous methods known to a person of ordinary skill in the art. The other half of the zipper may be fixed to the other side of upper section 10 by using epoxy, stitching, or any other numerous methods known to a person of ordinary skill in the art.

Coupling mechanism 20 may be continuous with coupling mechanism 21 such that a single, continuous operation may attach (or remove) one side of the upper section with another side of the upper section while also attaching (or removing) the upper section from the shoe. For example, in a preferred embodiment, one half of coupling mechanism 20 and one half of coupling mechanism 21 are comprised of portions of the same single continuous structure. In other words, an upper portion of a single continuous structure constitutes one half of coupling mechanism 20 and a lower portion of that single continuous structure constitutes one half of coupling mechanism 21. In this preferred embodiment, the other half of coupling mechanism 20 is separate from the other half of coupling mechanism 21. That is, the structure that constitutes the other half coupling mechanism 20 does not also constitute the other half of coupling mechanism 21.

In a preferred embodiment, coupling mechanism 20 and coupling mechanism 21 both comprise zippers fixed to one another in such a way as to allow a single, continuous zipper operation to attach or remove one side of upper section 10 with another side of upper section 10 while also attaching or removing, respectively, upper section 10 from the shoe 11. Some preferred embodiments are explained in more detail with reference to FIG. 2A, 2B and FIG. 3A, 3B.

In another preferred embodiment, the coupling mechanisms 20 and 21 are obscured from view. This may be accomplished by using a very small coupling mechanism, such as a very small zipper, magnets, Velcro, buttons, or any other small coupling mechanism known to a person of ordinary skill in the art. This may also be accomplished by extending the material of upper section 10 and/or shoe 11 such that the material covers the coupling mechanisms 20 and 21, and thereby obscures the coupling mechanisms 20 and 21 from view. In yet another preferred embodiment, shoe 11 may be flat. In yet another preferred embodiment, shoe 11 may additionally comprise a heel.

Figure 2A:
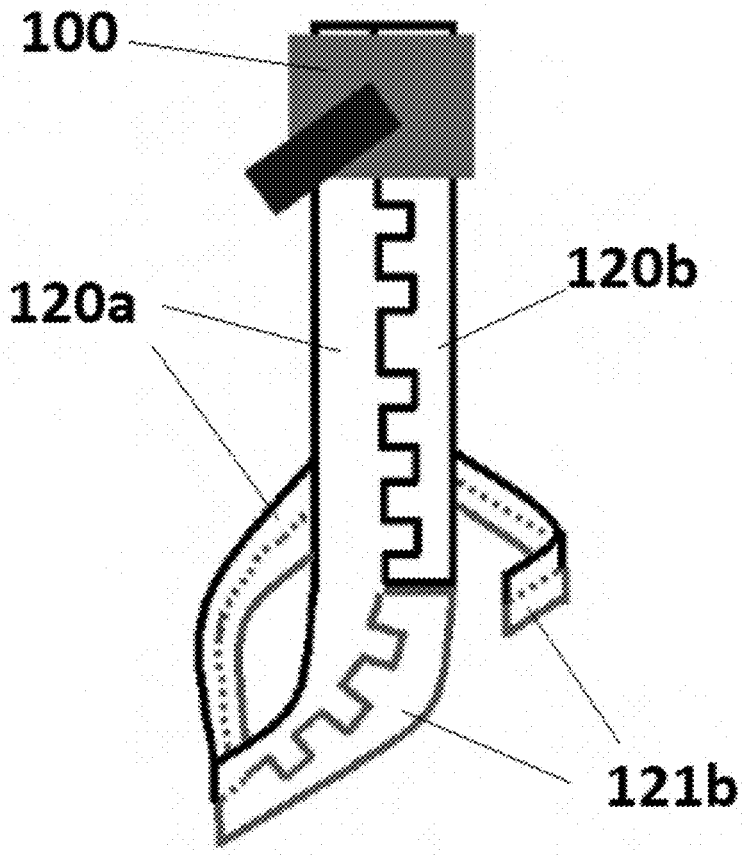
FIG. 2A shows an exemplary embodiment of the invention illustrating a zipper, fully zipped up, configured to attach and detach the upper section of a boot.
Figure 2B:
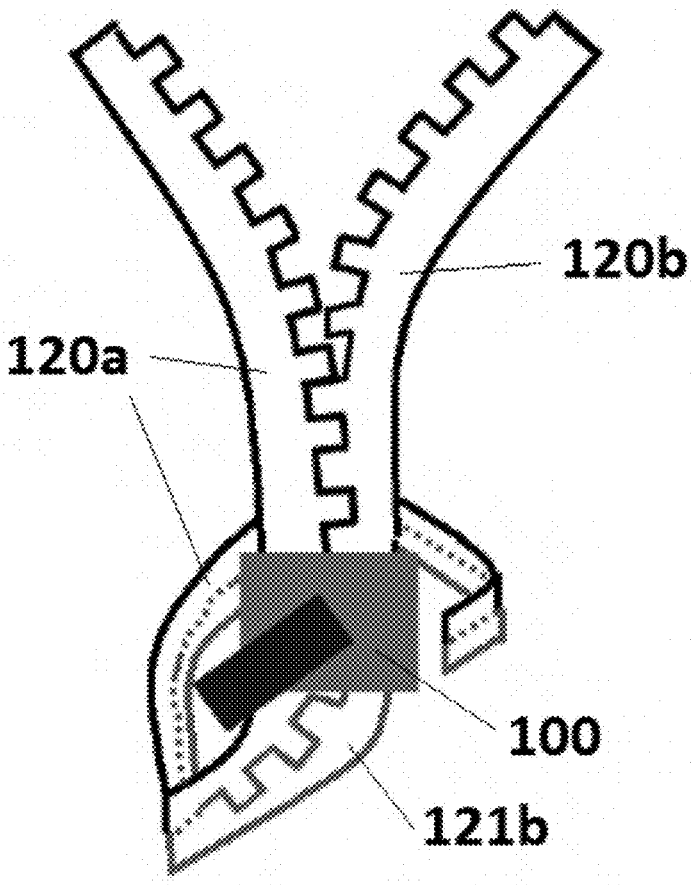
FIG. 2B shows an exemplary embodiment of the invention illustrating a zipper, partially unzipped, configured to attach and detach the upper section of a boot.

As illustrated in FIGS. 2A and 2B, a preferred embodiment of the invention includes coupling mechanisms 20 and 21 comprising zippers. FIG. 2A shows an exemplary embodiment of the invention illustrating a zipper, fully zipped up, configured to attach and detach the upper section of a boot. The upper part of zipper half 120*a* may be fixed to one side of upper section 10 while zipper half 120*b* may be fixed to the other side of upper section 10. Zipper half 120*b* ends at the bottom of upper section 10. Therefore, in a preferred embodiment, coupling mechanism 20 comprises the upper part of zipper half 120*a* and zipper half 120*b*. The lower part of zipper half 120*a* may continue past zipper half 120*b*, such that it may connect with zipper half 121*b*. Zipper half 121*b* may be fixed to shoe 11, such that lower part of zipper half 120*a* and zipper half 121*b* are configured to removably attach upper section 10 to shoe 11. Therefore, in a preferred embodiment, coupling mechanism 21 comprises lower part of zipper half 120*a* and zipper half 121*b*. Zipper block 100 travels the entire length of zipper half 120*a*, in order to connect (or disconnect) the upper part of zipper half 120*a* with zipper half 120*b*, and in order to connect (or disconnect) the lower part of zipper half 120*a* with zipper half 121*b*. Zipper block 100 may connect (or disconnect) the zipper halves by using conventional zipper teeth interlocking understood by a person of ordinary skill, or by any other means understood by a personal of ordinary skill.

FIG. 2B shows an exemplary embodiment of the invention illustrating a zipper, partially unzipped, configured to attach and detach the upper section of a boot. As shown in the figure, zipper block 100 may travel down zipper half 120*a* to disconnect both zipper half 120*b* and zipper half 121*b* in a single, continuous zipper operation. Therefore, one side of upper section 10 may be decoupled from the other side of upper section 10, and upper section 10 may be removed from shoe 11 with a single, continuous zipper operation. Conversely, when the zipper block travels in the opposite direction, upper section 10 may be attached to shoe 11, and one side of upper section 10 may be coupled to the other side of upper section 10 with a single, continuous zipper operation.

Figure 3A:
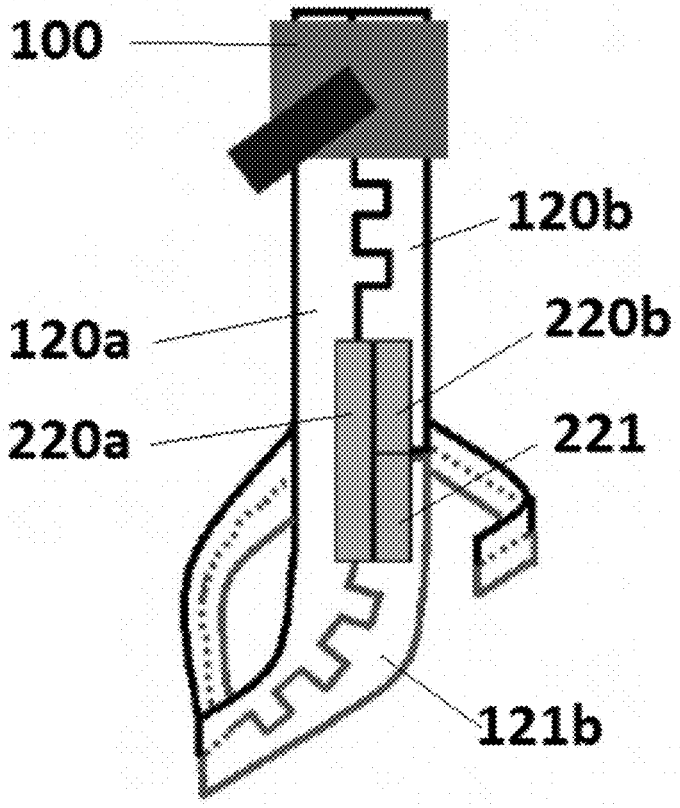
FIG. 3A shows an exemplary embodiment of the invention illustrating an alternative type of zipper, fully zipped up, configured to attach and detach the upper section of a boot.
Figure 3B:
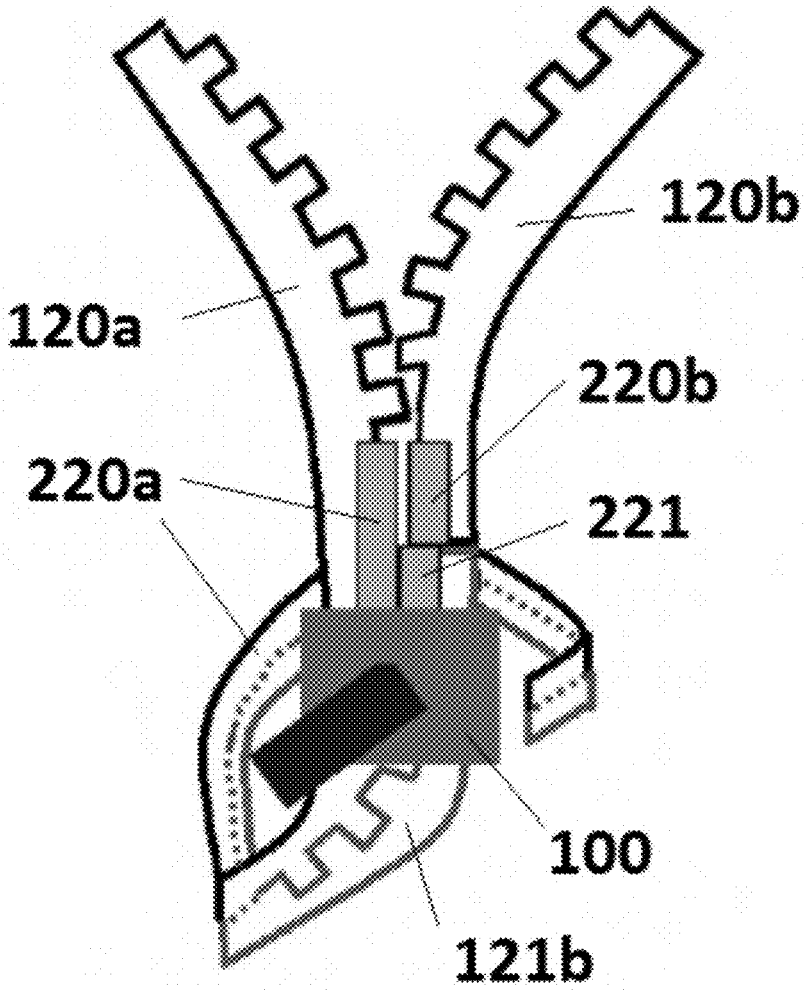
FIG. 3B shows an exemplary embodiment of the invention illustrating an alternative type of zipper, partially unzipped, configured to attach and detach the upper section of a boot.

As illustrated in FIGS. 3A and 3B, a preferred embodiment of the invention includes coupling mechanisms 20 and 21 comprising zippers. FIGS. 3A and 3B comprise all of the components of FIGS. 2A and 2B, but further comprise two end stops and a bridge stop. End stop 220*b* may replace the end of zipper half 120*b* with a rectangular section, comprising plastic, metal, or any other suitable material known to a person of ordinary skill. It is known to a person of ordinary skill how to replace the end of a zipper half with an end stop, as it is typical to use such end stops at the ends of zipper halves. However, in accordance with a preferred embodiment of the invention, and unlike typical zippers, end stop 220*b* at the end of zipper half 120*b* may be adjacent to end stop 221 at the end of zipper half 121*b*. End stop 221 may replace the end of zipper half 121*b* with a rectangular section, comprising plastic, metal, or any other suitable material known to a person of ordinary skill. Additionally, each of these end stops may be adjacent to bridge stop 220*a*. Bridge stop 220*a* may replace a section of zipper half 120*a* with a rectangular section, comprising plastic, metal, or any other suitable material known to a person of ordinary skill. Bridge stop 220*a* may be the size of end stops 220*b* and 221 combined and may function to facilitate the single, continuous motion of zipper block 100. This is shown in FIG. 3B, which displays an exemplary embodiment of the invention illustrating a zipper, partially unzipped, configured to attach and detach the upper section of a boot.

In another preferred embodiment, not shown, bridge stop 200*a* may be used to fuse together two shorter zipper halves to comprise zipper half 120*a*. This may ease manufacturing, as it may be more efficient to manufacture two separate zipper halves joined at a bridge stop than to manufacture one monolithic zipper half with a bridge stop in the middle.

Many modifications and other embodiments of the inventions set forth herein will come to mind to one skilled in the art to which these inventions pertain having the benefit of the teachings presented in the foregoing descriptions and the associated figures. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A convertible footwear apparatus comprising:

an upper section comprising a substantially rectangular structure;

a shoe section comprising a vamp portion, a heel portion, and a sole portion, wherein the vamp portion has two lateral sides and a medial side, said lateral sides being attached to the sole portion, said medial side connecting the two lateral sides and the upper edge of the shoe section, and wherein the heel portion comprises a rear portion of the shoe section and is attached to the sole portion;

and a coupling mechanism comprising a zipper, wherein the upper section and the coupling mechanism are configured to removably attach at least one side of the upper section to at least another side of the upper section and to removably attach the upper section to the shoe section with a single continuous zipper operation, wherein one half of the zipper comprises a single continuous structure coupled to the upper section and the other half of the zipper comprises at least two distinct structures one of which is coupled to the upper section and the other of which is coupled to the shoe section.

2. The convertible footwear apparatus of claim 1 further comprising means for obscuring the coupling mechanism from view.

3. The convertible footwear apparatus of claim 1, wherein the shoe further comprises a heel.

4. A method of converting a convertible footwear apparatus comprising the steps of:

providing an upper section comprising a substantially rectangular structure;

providing a shoe section comprising a vamp portion, a heel portion, and a sole portion, wherein the vamp portion has two lateral sides and a medial side, said lateral sides being attached to the sole portion, said medial side connecting the two lateral sides and the upper edge of the shoe section, and wherein the heel portion comprises a rear portion of the shoe section and is attached to the sole portion;

providing a coupling mechanism comprising a zipper, wherein the upper section and said coupling mechanism are configured to removably attach at least one side of the upper section to at least another side of the upper section and to removably attach the upper section to the shoe section with a single continuous zipper operation, wherein one half of the zipper comprises a single continuous structure coupled to the upper section and the other half of the zipper comprises at least two distinct structures one of which is coupled to the upper section and the other of which is coupled to the shoe section; and removably attaching, with a single continuous operation, an upper section to a shoe section and removably attaching one side of said upper section to another side of said upper section.

* * * * *